United States Patent [19]

Allan et al.

[11] 3,971,503

[45] July 27, 1976

[54] SANITARY PAPERBOARD SCOOP AND CONTAINER

[75] Inventors: Roger J. Allan, Conshohocken; Joseph J. Hart, Philadelphia, both of Pa.

[73] Assignee: Container Corporation of America, Chicago, Ill.

[22] Filed: Jan. 27, 1975

[21] Appl. No.: 544,325

[52] U.S. Cl. ..... 229/38; 15/257.1; 206/496; 229/41 B; 294/1 R

[51] Int. Cl.[2] ..... B65D 5/08

[58] Field of Search ..... 15/257.1; 206/496; 229/41 B, 44 R, 38, 39 R; 294/1 R, 55

[56] References Cited

UNITED STATES PATENTS

| | | | |
|---|---|---|---|
| 1,037,347 | 9/1912 | Smith | 229/38 |
| 2,692,721 | 10/1954 | Pennebaker et al. | 229/39 R X |
| 2,702,154 | 2/1955 | Linson | 229/39 R |
| 3,365,114 | 1/1968 | Macchi | 229/38 |
| 3,630,430 | 12/1971 | Struble | 229/41 B X |
| 3,799,425 | 3/1974 | Fanter | 229/39 R |
| 3,877,632 | 4/1975 | Steel | 229/41 B |

FOREIGN PATENTS OR APPLICATIONS

| | | | |
|---|---|---|---|
| 1,133,776 | 11/1968 | United Kingdom | 229/44 R |

*Primary Examiner*—Stephen P. Garbe
*Attorney, Agent, or Firm*—Carpenter & Ostis

[57] ABSTRACT

A collapsible combination paperboard scoop and container comprising a tubular body open at the top, an integral hinged cover, and means associated with the body for locking the cover in a closed position.

1 Claim, 17 Drawing Figures

SANITARY PAPERBOARD SCOOP AND CONTAINER

BACKGROUND OF THE INVENTION

1. Field of the Invention

This invention relates to sanitary containers such as folding cartons which are designed and constructed to be used primarily for scooping up and retaining animal excreta from the ground.

2. The Prior Art

The prior art is exemplified in the following United States patents developed in a search:

| | | |
|---|---|---|
| DeMeza | 268,636 | December 5, 1882 |
| Coats | 1,106,282 | August 4, 1914 |
| Hurff | 1,364,556 | January 4, 1921 |
| Stephens | 2,087,038 | April 20, 1937 |
| Coats | 2,453,973 | November 16, 1948 |
| Franck | 2,740,576 | April 2, 1956 |
| Andre | 2,787,408 | April 2, 1957 |
| Charie | 3,345,670 | October 10, 1967 |
| Levinson | 3,534,424 | October 20, 1970 |
| Wetzler | 3,767,247 | October 23, 1973 |

The present invention represents an advantage since the tubular structure includes a closure arrangement unlike any found in the prior art.

SUMMARY OF THE INVENTION

The invention is directed to a collapsible scoop and container formed from a unitary blank of foldable paperboard and comprising a tubular body and hinged cover adapted to interlock with the body when in closed position.

THE DRAWINGS

Figure 1:
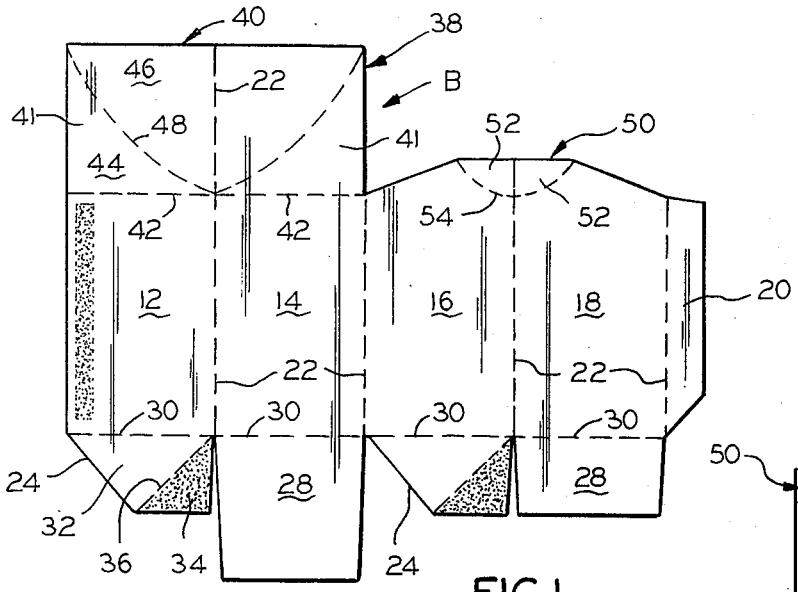
FIG. 1 is a plan view of a blank from which the scoop and container illustrated in FIGS. 2 through 6 may be formed.

FIGS. 13, 14, 15, 16, and 17 are views similar to FIGS. 1, 2, 3, 5, and 6, respectively, but illustrate yet another modified form of the invention.

It will be understood that certain elements may have been intentionally omitted from certain views where they are believed to be illustrated to better advantage in other views.

Referring now to the drawings for a better understanding of the invention, it will be seen that one embodiment of the scoop is illustrated in FIGS. 1 through 6.

Figure 3:
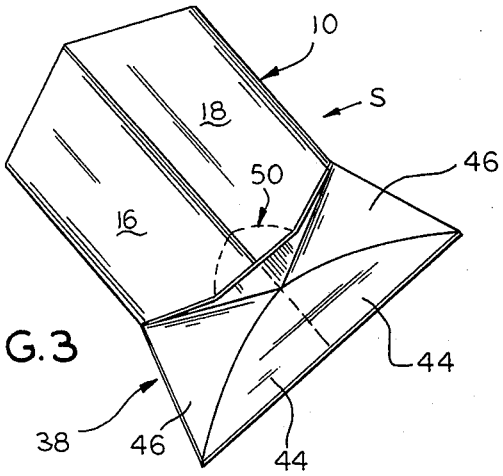
FIG. 3 is a perspective view of the scoop shown in an erected and open position and illustrating the manner in which the scoop may be used.
Figure 4:
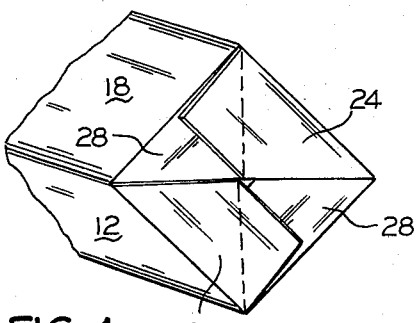
FIG. 4 is a fragmentary perspective view of the bottom of the scoop shown in the erected condition.

The scoop indicated generally at S in FIG. 3 may be formed from a unitary blank of foldable paperboard indicated generally at B in FIG. 1 of the drawings.

Referring to FIG. 1, it will be seen that the scoop S comprises a generally tubular body member 10 formed from a plurality of serially arranged side walls 12, 14, 16, and 18, and a glue flap 20, hingedly attached to each other along parallel score lines 22. The bottom of the structure in this embodiment is preferably an automatic type bottom comprising opposed pairs of bottom closure flaps 24 and 28 hingedly connected to the lower edges of the side walls along aligned score lines 30. Bottom closure flaps 24 are connected to side walls 12 and 16, while bottom closure flaps 28 are connected to side walls 14 and 18. Each of the bottom closure flaps 24 includes a first section 32 hingedly attached at one edge to its related side wall and a second section 34 hingedly attached to another edge of first section 32 along fold line 36. The bottom closure flaps may be secured to each other in overlapping relation in a conventional manner.

Figure 5:
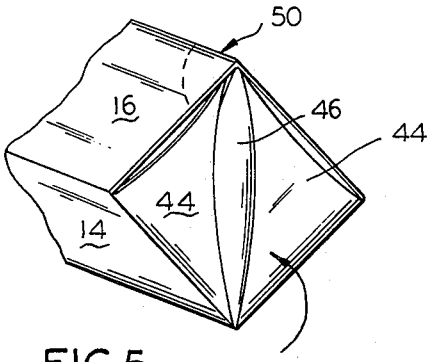
FIG. 5 is a fragmentary perspective view of the top of the scoop with the cover shown in a closed position.
Figure 6:
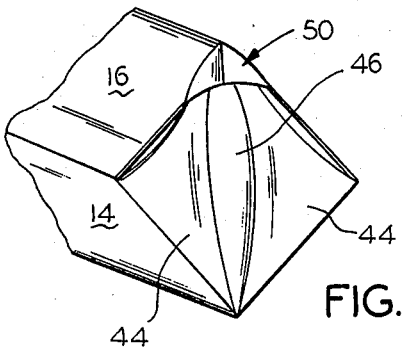
FIG. 6 is a view similar to FIG. 5, but with the cover in a closed and locked position.

The body portion of the scoop is normally open at the top and includes an integral cover member 38 which serves both as a scoop, when it is in the open position as illustrated in FIG. 3, and as a means of closing the carton when it is in the closed position as shown in FIGS. 5 and 6.

Cover member 38 is formed from top closure flaps 41 which are hingedly connected along aligned hinge lines 42 to the upper edges of two of the side walls, preferably side walls 12 and 14, and which are also hingedly connected to each other along score line 22, which is an extension of the same score line which connects side walls 12 and 14.

Each top closure flap 41 includes a cover panel 44, which is hingedly attached to the related side wall, and a gusset panel 46, which is hingedly attached to its related cover panel 44 by a preferably curved score line 48 extending generally diagonally across the top closure flap 41 from the juncture of score lines 42 and 22 to the opposite corner of the flap. Gusset panels 46 of the closure flaps are hingedly attached to each other along score line 22. Together, gusset panels 46 form the gusset section 40.

Still referring to FIG. 1, it will be seen that the side walls 16 and 18 are slightly longer or higher than side wall panels 12 and 14, and jointly include a lock portion 50 which comprises a pair of generally pie-shaped panels 52 which are defined by the upper edges of side walls 16 and 18 and by a semicircular score line 54. Panels 52 are hingedly connected to each other along related score line 22, which is an extension of the hinge line connecting side walls 16 and 18.

Figure 2:
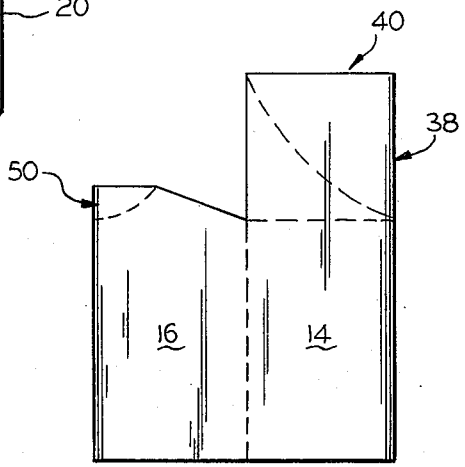
FIG. 2 is a side elevation of a scoop, embodying features of the invention, as shown in a collapsed condition.

Thus, when the scoop is formed by the manufacturer with the bottom closure flaps secured in place and the glue flap 20 secured to the remote side wall 12, the scoop may be shipped in a collapsed condition as shown in FIG. 2.

In order to erect the scoop for use, pressure is exerted by the operator against the diagonally opposite corners of the scoop. This opens the structure, which is a combination scoop and container, so that the cover member is in the extended position as illustrated in FIG. 3. It may then be used as a scoop to pick up dog excreta or any other product. After the body member has been filled, pressure is exerted on the cover member and it is folded downwardly with the gusset panels 46 being folded in face-to-face relationship between the two cover panels 44. To lock the cover member in the closed position, pressure is exerted on the upper extension of score line 22 between panels 16 and 18 to depress lock portion 50, which is also in the form of a gusset or bellows, and which then engages the upper surface of the corners of cover panels 44 to maintain the cover member in a closed position.

Thus, it will be understood that gusset portion 40 of cover member 38 serves two purposes, namely, to widen the cover when the cover is used as a scoop, and also, to facilitate closing of the cover over the body of the container.

Another form of the invention is illustrated in FIGS. 7 through 12. This embodiment, like the one described previously, includes a combination scoop and container indicated generally at S′ in FIG. 9 which may be formed from a unitary blank of foldable paperboard indicated generally at B′ in FIG. 7.

Figure 7:
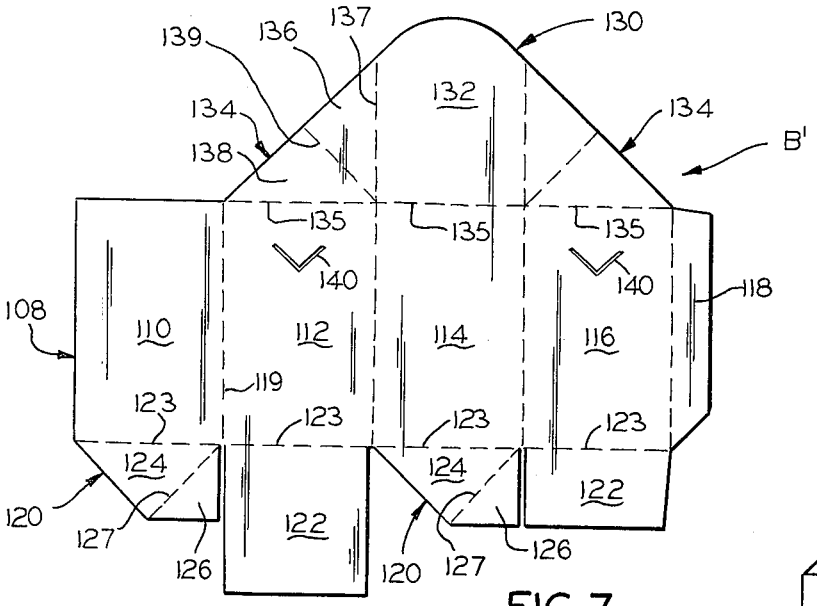
FIGS. 7 through 12 are views similar to FIGS. 1 through 6 but illustrate a modified form of the invention.

Referring to FIG. 7, it will be seen that scoop S′ comprises a generally tubular body member 108 formed from a plurality of serially arranged side walls 110, 112, 114, and 116, and a glue flap 118 hingedly attached to each other along parallel score lines 119. Closure of the bottom of the body member is preferably an automatic type bottom comprising opposed pairs of bottom closure flaps 120 and 122 hingedly connected to the lower edges of the side walls along aligned score lines 123. Bottom closure flaps 120 are connected to side walls 110 and 114, while bottom closure flaps 122 are connected to side walls 112 and 118. Each of the bottom closure flaps 120 includes a first section 124 hingedly attached at one edge to its related side wall and a second section 126 hingedly attached to another edge of first section 124 along fold line 127. The bottom closure flaps may be secured to each other in overlapping relation in a conventional manner.

Figure 9:
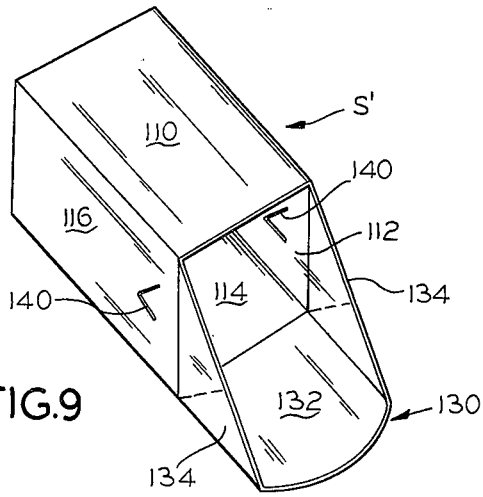
Figure 10:
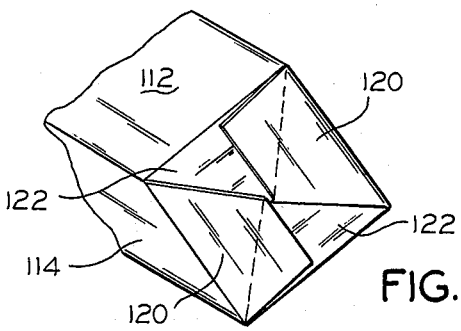
Figure 11:
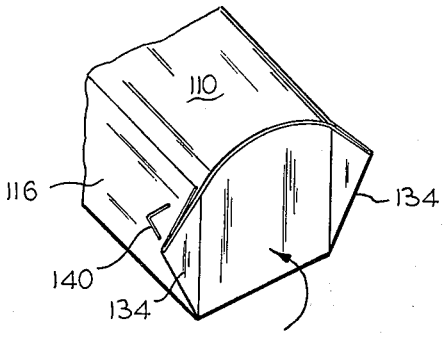
Figure 12:
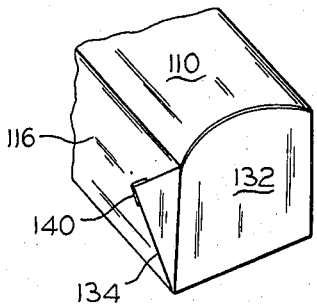

The body member 108 of the scoop/container is normally open at the top and includes an integral cover member 130 which serves both as a scoop, when it is in the open position as illustrated in FIG. 9, and as a means of closing the top of the carton, when it is in the closed position as shown in FIGS. 11 and 12.

Cover member 130 includes a central cover panel 132 and a pair of side gusset portions 134, which are hingedly attached to upper edges of the side walls 114, 112, and 116, respectively, along aligned score lines 135. Each of the gusset portions 134 includes a pair of generally triangular gusset panels, the first gusset panel 136 being hingedly attached at one side edge on score line 137 to one side of cover panel 132, and having hingedly attached to an opposed side edge along score line 139, a second gusset panel 138, which in turn is hingedly attached along score line 135 to a related side wall.

Side walls 112 and 116 are each provided with a locking aperature 140 formed by a generally V-shaped cut therein. The function of the locking aperature will be described later in the specification.

Figure 8:
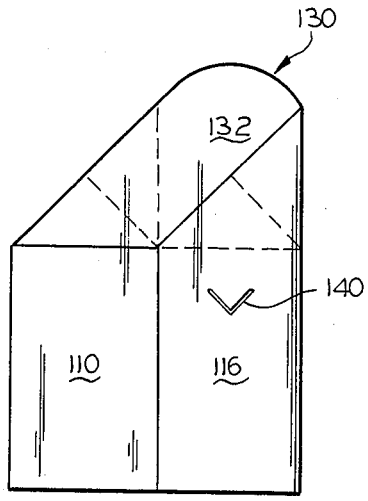

When the scoop-container is formed by the manufacturer with the bottom closure flaps secured in place and the glue flap 118 secured to the remote side wall 110, the article may be shipped in a collapsed condition as shown in FIG. 8.

In order to erect the device for use, pressure is exerted by the operator against diagonally opposed corners of the article. This opens the structure, which is a combination scoop and container, so that the cover member is in extended position as illustrated in FIG. 9. It may then be used as a scoop. After the body member has been filled, the container may be closed by folding the cover panel 132 forwardly at right angles to the rear side wall 114, and the cover may be locked in position by bending down the gusset members 134 and tucking the corners thereof in the locking slots 140 as illustrated in FIG. 12 of the drawings. Thus, it will be understood that in this embodiment, as in the previously described embodiment of the invention, the gusset portion 134 of the cover member 130 cooperates with the cover panel 132 to provide a scoop enclosed at the sides for picking up material from the ground, and also serves to facilitate closing and locking of the cover member over the body member.

Now referring to FIGS. 13 through 17 of the drawings, it will be seen that still another embodiment of the invention is shown. In this embodiment, as in the case of the previously described embodiments a combination scoop and container indicated generally at S″ in FIG. 15 may be formed from a unitary blank of foldable paperboard indicated generally at B″ in FIG. 13 of the drawings.

This embodiment, like the other embodiments, has a generally tubular body member indicated generally at 208 and a cover member cooperating therewith which operates in substantially the same manner as the cover members of the other embodiments. However, this embodiment is of slightly different construction than the body members of the earlier embodiments.

Figure 13:
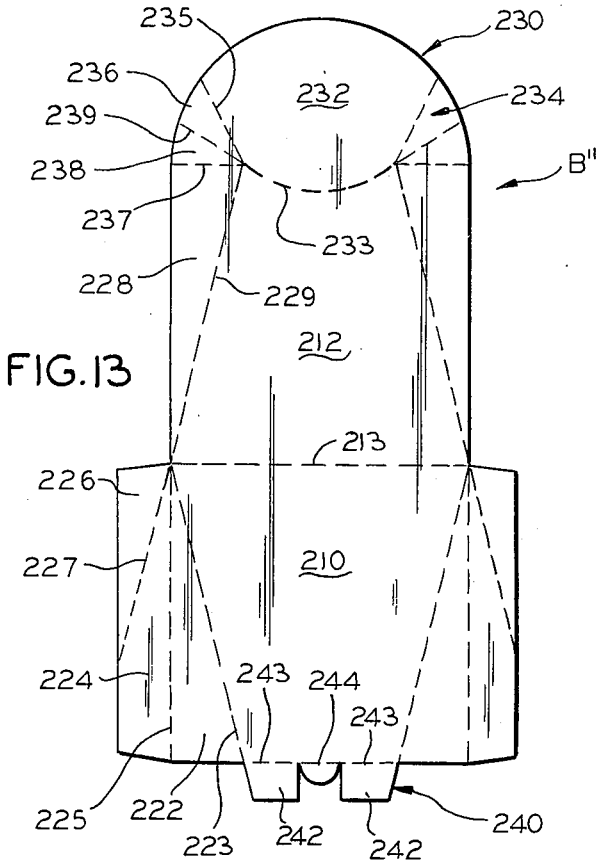
Figure 15:
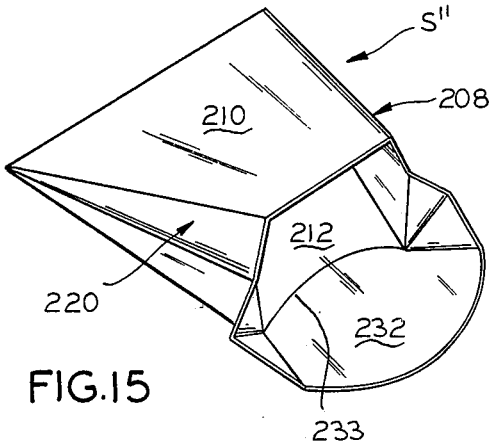

As best seen in FIGS. 13 and 15, body member 208 comprises a pair of front and rear side walls 210 adn 212, respectively, which are hingedly connected at their lower edges by hinge line 213, and which are joined to each other at their side edges by a pair of opposed end walls 220.

Figure 14:
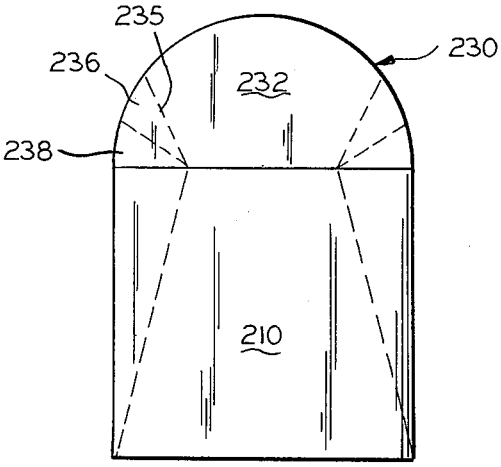

Still referring to FIGS. 13 and 14, it will be seen that each of the end walls 220 comprises a plurality of panels hingedly attached to the front and rear side walls and secured to each other in overlapped relation to form a bellows-type element foldable along a medial score line to permit the article to be collapsed as illustrated in FIG. 14. Each end wall 220 includes a first panel 222 hingedly attached to front wall 210 along an inclined score line 223; a second panel 224 hingedly attached to first panel 222 along score line 225; a third panel 226 hingedly attached to second panel 224 along score line 227; and a fourth panel 228 hingedly attached to rear side wall 212 along an inclined score line 229.

When the carton is formed by the manufacturer, front and rear side walls are folded together with third panel 226 being adhesively secured to the inner surface of rear side wall 212, and second panel 224 secured to the inner surface of fourth panel 228.

Thus, the end walls each end up with two panels in effect, which are hingedly attached and foldable with respect to each other along score line 225, and which are foldable with respect to the front and rear side walls along score lines 229 and 223 when the container is open.

Figure 16:
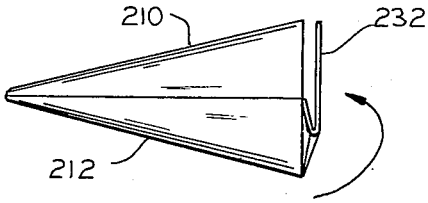
Figure 17:
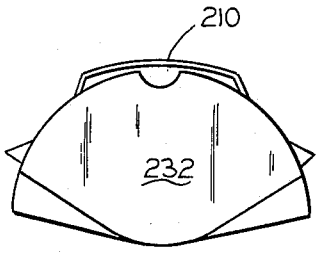

The body portion of the container is normally open at the top and includes an integral cover member 230, which serves both as a scoop when in the open position as illustrated in FIG. 15, and as means of closing the container when it is in the closed position as shown in FIGS. 16 and 17.

Cover member 230 includes a central or cover panel 232 hingedly attached along score line 233 to the upper edge of rear side wall 212, and a pair of side gusset portions 234. Each gusset portion 234 includes a first panel 236 hingedly attached at one side edge to one side of cover panel 232 along score line 235, and a second panel 238 hingedly attached at one edge along score line 237 to the upper edge of related fourth end wall panel 228. The two gusset panels of each gusset section are hingedly attached to each along a common fold line 239.

As best seen in FIGS. 13 and 17, a cover locking portion indicated generally at 240 is provided at the front of the container. The locking portion includes a pair of glue tabs 242 spaced from each other and a lock tab 244 interposed therebetween. The glue tabs and the lock tab are hingedly attached to the upper edge of front side wall 210 along a common score line 243. When the carton is formed, the glue tabs 242 are folded 180° and secured in face-to-face relation with the inner surface of front side wall 210, but the lock tab 244, as held in position by the flanking glue tabs, projects inwardly at substantially right angles to the front side wall 210 to form a retaining or locking lip as best seen in FIG. 17.

In order to erect the device for use, pressure is exerted against the opposed side walls of the article. This opens the structure, which is a combination scoop and container, so that the cover member is in an extended position as illustrated in FIG. 15.

It may then be used as a scoop to introduce material into the container. After the body member has been filled, it may be closed by folding the cover panel forwardly and snapping the front edge of the cover panel under the locking tab 244 to lock the cover in a closed position as illustrated in Figure.

Thus, it will be understood that in this embodiment, as in the case of the previously described embodiments, the gusset portion 234 of the cover member serves to widen the cover when the cover is a scoop, and also to facilitate closing the cover over the body of the container.

We claim:

1. A collapsible combination sanitary scoop and container device formed from a unitary blank of foldable paperboard, comprising, in combination:

a. a plurality of side walls hingedly interconnected to form a generally tubular body member open at one end;

b. an integral cover member hingedly connected to an upper edge of said body member and being operable to serve both as a scoop for introducing material into said body member and as a cover for closing the open end of said body member;

c. said cover member comprising:

i. a cover element including a pair of cover panels spaced from each other;

ii. a gusset element interposed between said cover panels and including a pair of foldably interconnected gusset panels;

iii. said cover and gusset elements being foldably joined to each other and to said body member to provide in cooperation with each other a scoop having rear and side portions of a combined width in excess of the width of any one of said body side walls;

d. said body member including means engageable with a portion of said cover member for locking said cover member in a closed position.

* * * * *